US005079483A

United States Patent [19]

Sato

[11] Patent Number: 5,079,483

[45] Date of Patent: Jan. 7, 1992

[54] ELECTROLUMINESCENT DEVICE DRIVING CIRCUIT

[75] Inventor: Yoshihide Sato, Kanagawa, Japan

[73] Assignee: Fuji Xerox Co., Ltd., Tokyo, Japan

[21] Appl. No.: 596,493

[22] Filed: Oct. 12, 1990

[30] Foreign Application Priority Data

Dec. 15, 1989 [JP] Japan ..... 1-325310

[51] Int. Cl.[5] ..... G09G 3/10; G09G 3/30

[52] U.S. Cl. ..... 315/169.3; 315/246; 340/781; 357/41

[58] Field of Search ..... 315/169.3, 246; 340/781; 357/41, 52

[56] References Cited

U.S. PATENT DOCUMENTS 3,708,717 1/1973 Fleming ..... 340/781
4,006,383 2/1977 Luo et al. ..... 315/169.3
4,087,792 5/1978 Asars ..... 315/169.3
4,114,070 9/1978 ..... 315/169.3
4,574,315 3/1986 Yoshimura ..... 315/169.3
4,602,192 7/1986 Nomura et al. ..... 315/169.3

*Primary Examiner*—Eugene R. LaRoche
*Assistant Examiner*—Tan Dinh
*Attorney, Agent, or Firm*—Finnegan, Henderson, Farabow, Garrett and Dunner

[57] ABSTRACT

An electroluminescent device driving circuit comprising first and second switching devices, a dividing capacitor, an electroluminescent device, and a driving power supply is described. The electroluminescent device illuminates when the second switching device is in an off-state (open). When the second switching device is in an on-state (closed), however, the electroluminescent device does not emit light. The second switching device can readily incorporate an offset drain structure.

9 Claims, 3 Drawing Sheets

ELECTROLUMINESCENT DEVICE DRIVING CIRCUIT

BACKGROUND OF THE INVENTION

1. Field of the Invention

The present invention relates to an electroluminescent device driving circuit used in exposure systems of matrix type electroluminescent display devices and electronic type printing apparatuses. In particular, the present invention relates to a circuit structure of an electroluminescent device driving circuit using amorphous silicon (a-Si) as the semiconductor layer of a film transistor for driving an electroluminescent device.

2. Description of the Related Art

FIG. 6 shows an electroluminescent device driving circuit for one bit of a matrix type electroluminescent display device or electroluminescent device array. The electroluminescent device circuit comprises a first switching device Q1, a storage capacitor Cs whose one terminal is connected to the source terminal of the first switching device Q1, a second switching device Q2 whose gate terminal is connected to the source terminal of the first switching device Q1 and whose source terminal is connected to the other terminal of the storage capacitor Cs, and an electroluminescent device CEL whose one terminal is connected to the drain terminal of the second switching device Q2 and whose other terminal is connected to an electroluminescent device driving power supply Va. The first switching device Q1 is turned on according to a switching signal SCAN. When the first switching device Q1 is turned on or off, it causes the storage capacitor Cs to be charged or discharged according to a luminance signal DATA. When the discharging voltage from the storage capacitor Cs is applied to the gate terminal, the second switching device Q2 is turned on, thereby causing the electroluminescent device CEL to become luminous by the electroluminescent device driving power supply Va.

When the second switching device Q2 of the electroluminescent device driving circuit shown in FIG. 6 is turned off, the electroluminescent device driving power supply, Va, is applied between the drain and the source of the second switching device Q2. Therefore, it is desirable for Q2 to have a high withstand voltage and low off-current. Accordingly, the semiconductor layer of second switching device Q2 may be made of cadmium selenide (CdSe) or polysilicon (polySi) in order to realize these characteristics.

However, as cadmium selenide degrades with time, the characteristic of drain voltage vs. drain current becomes unstable. Consequently, it is difficult to keep the luminance of the electroluminescent device CEL constant. On the other hand, when polysilicon (polySi) is used, the process temperature for its deposition should be set to a high value. Thus, a large size device cannot be fabricated by depositing the electroluminescent device CEL, which would be degraded by the heat, and the second switching device Q2 on the same substrate.

To solve the aforementioned problems associated with cadmium selenide (CdSe) and polysilicon (polySi), a device with a high withstand voltage may be realized using amorphous silicon, which needs only more moderate process temperature. When such a device with an achievable withstand voltage is used, the device provides characteristics with respect to withstand voltage and off-current which are sufficient for operation as a switching device. However, when the drain voltage is negative, as shown in FIG. 3, drain current is reduced. Therefore, the electroluminescent device driving power supply Va would need to be increased in order to drive the electroluminescent device CEL. Thus, it is impractical to implement the driving circuit shown in FIG. 6 when the semiconductor layer of the second switching device Q2 is made of amorphous silicon.

As shown in FIG. 7, a driving circuit having a dividing capacitor Cdv disposed in parallel with the second switching device Q2 has been proposed. In this circuit, the second switching device Q2 can be designed which requires only a relatively low withstand voltage. However, when amorphous silicon is used for the semiconductor layer, a switching device with a sufficient withstand voltage for the configuration of FIG. 7 has not been achieved. Moreover, when the state of the second switching device Q2 is changed from ON to OFF, a voltage Va equal to the DC component of the electric charge stored in the dividing capacitor Cdv plus to the required voltage VEL of the electroluminescent device is needed for luminescence and will eventually be applied across the drain and source of the second switching device Q2. Consequently, an excessive voltage may be applied across the drain and source of the second switching device Q2 resulting in the electrochemical reaction acceleration factor which reduces the reliability thereof.

SUMMARY OF THE INVENTION

An object of the present invention is to solve the above problems and to provide an electroluminescent device driving circuit wherein the semiconductor layer of a film transistor for driving an electroluminescent device can be made of amorphous silicon (a-Si).

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an electroluminescent device driving circuit comprising: a first switching device having first, second, and third terminals, the second terminal acting to open or close said first switching device in accordance with a switching signal applied thereto, wherein a current flows between the first and third terminals when said first switching device is closed; a second switching device having first, second, and third terminals, the second terminal acting to close said second switching device in accordance with a voltage applied thereto, wherein a current flows between the first and third terminals when said first switching device is closed, the third terminal of said first switching device being electrically coupled to the second terminal of said second switching device; and an electroluminescent device having first and second terminals, the first terminal of said electroluminescent device being electrically coupled to the first terminal of said second switching device and the second terminal of said electroluminescent device being electrically coupled to the third terminal of said second switching device, wherein the electroluminescent device illuminates when said second switching device is open.

Accordingly, the electroluminescent device driving power supply is applied to the electroluminescent device when the second switching device is turned off. Therefore, the material of the semiconductor layer of the second switching device can be widely selected without disadvantageously affecting the characteristics of the switching device upon illumination of the electroluminescent device.

Also, since amorphous silicon (a-Si) may be used, large devices with small aging distortion of the drain current vs. drain voltage characteristic can be easily realized.

Further, since the second switching device can incorporate and offset drain structure, devices with a high withstand voltage can be realized.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
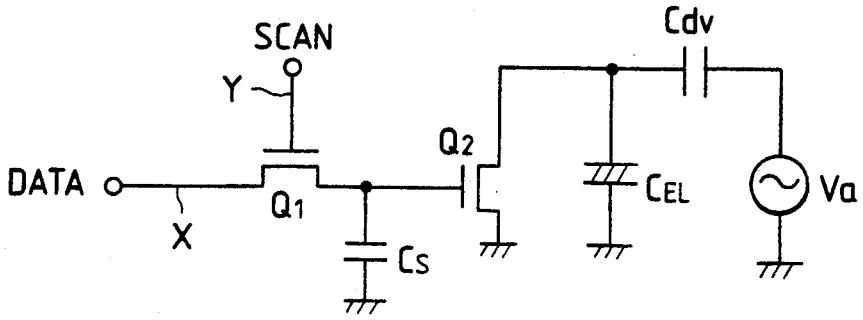
FIG. 1 is a schematic of an electroluminescent device driving circuit according to an embodiment according to the present invention.

FIG. 1 is a circuit diagram of an electroluminescent device driving circuit according to an embodiment of the present invention. The diagram shows the electroluminescent device driving circuit for one bit of a matrix type electroluminescent display device and a electroluminescent device array.

Luminance signal DATA is supplied to an information signal line X connected to the drain of first switching device Q1, the storage capacitor Cs whose minus (−) terminal is grounded is connected to the source of switching device Q1. The switching signal SCAN is applied to a switching signal line Y connected to the gate of the first switching device Q1. The source of the first switching device Q1 is connected to the gate of the second switching device Q2. The electroluminescent device driving power supply Va ($Va=Vpk \sin(\omega t)$) is connected to the drain of the second switching device Q2 through the dividing capacitor Cdv. On the other hand, the source of the second switching device Q2 is grounded and the electroluminescent device CEL is connected between the drain and the source of the second switching device Q2.

Figure 2:
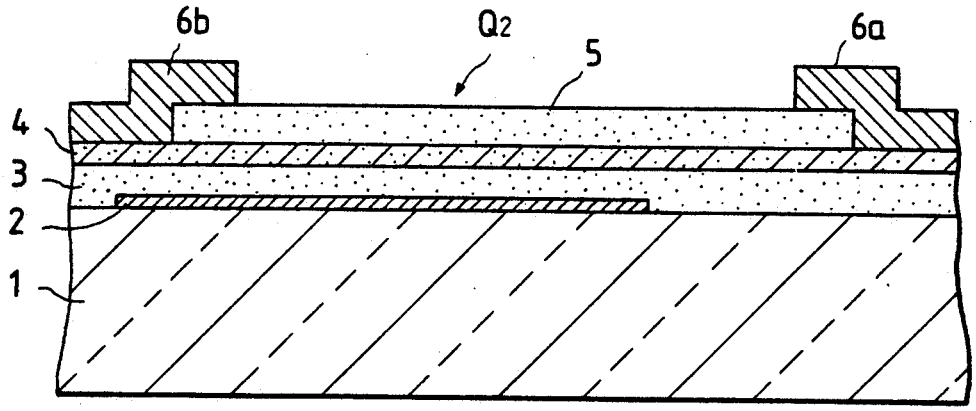
FIG. 2 is a sectional view of a switching device having an offset drain structure.
Figure 3:
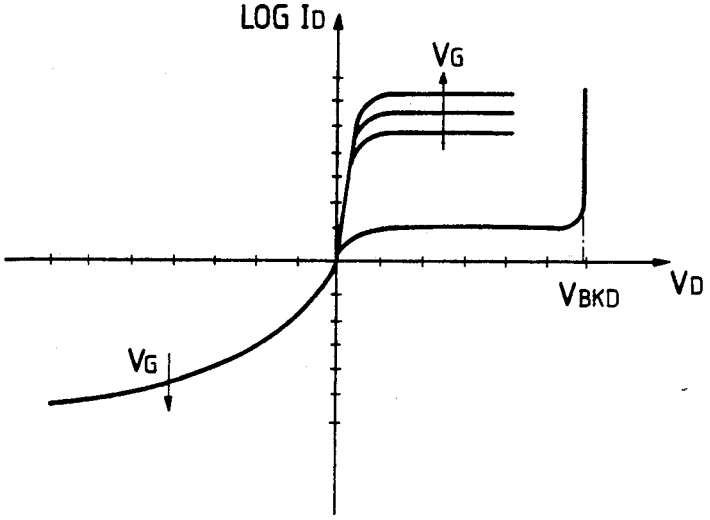
FIG. 3 is a plot of log(drain current)vs. drain voltage of a switching device having an offset drain structure.

As shown in FIG. 2, the second switching device Q2 comprises a substrate 1, a gate electrode 2 made of a metal such as chromium (Cr) or the like, an insulation layer 3 made of $SiN_x$, a semiconductor layer 4 made of amorphous silicon (a-Si), an upper insulation layer 5, a drain electrode 6*a*, and a source electrode 6*b*, each of which is layered on the substrate 1 in that order. As shown in FIG. 2, the drain electrode 6*a* does not overlap the gate electrode 2. This construction is referred to as an offset drain structure. The second switching electrode 6*a* can have a high withstand voltage, due to this offset drain structure. However, as seen in FIG. 3, upon application of a negative drain voltage, drain current is reduced.

By referring to driving waveforms shown in FIG. 4, the operation of the aforementioned driving circuit will be described as follows.

Figure 4:
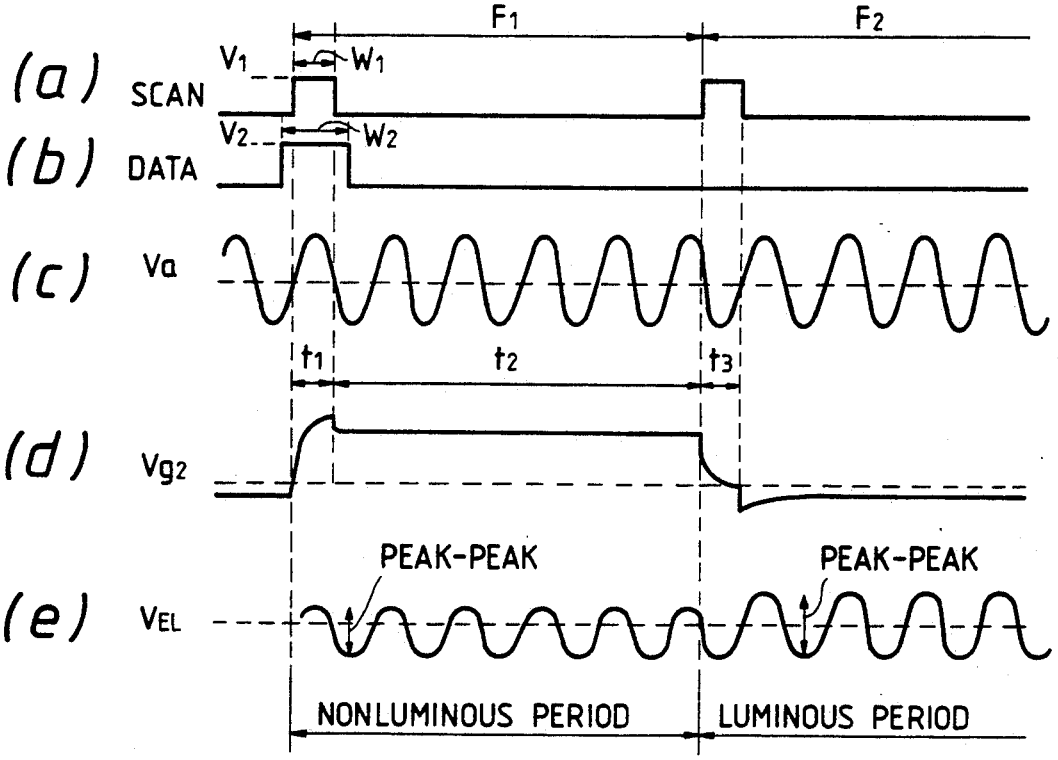
FIG. 4 is a timing diagram showing the operation of the electroluminescent device driving circuit according to the present invention.

As shown in FIG. 4 (*a*), when the switching signal SCAN having a pulse width W1 and pulse voltage is V1 is applied to the switching signal line Y connected to the gate of the first switching device Q1 in time period t1 of frame time period F1, the state of the first switching device Q1 becomes closed (ON). At the same time, as shown in FIG. 4 (*b*), when the luminance signal DATA having pulse width W2 and pulse voltage V2 is applied, the storage capacitor Cs is charged through the ON resistance (Ron) of the first switching device Q1. At this time, the voltage Vcs at both terminals of the storage capacitor Cs changes according to $Vcs=V2\ (1-\exp(-t/\tau 1)$ as shown in FIG. 4 (*d*) ($\tau 1=Ron\times Cs$).

After the time period t1 elapsed, the voltage V2 of the information signal line X becomes 0 and the state of the first switching device Q1 becomes open (OFF). At that time, the electric charge being charged in the storage capacitor Cs starts discharging through the off-resistance (Roff) of the first switching device Q1. The gate voltage Vg2 is the same as the voltage Vcs at both the terminals of the storage capacitor Cs and varies in the time period t2 according to $Vcs=Vg2=V2\exp(-t/\tau 2)$ ($\tau 2=Roff\times Cs$) as shown in FIG. 4 (*d*).

In the subsequent frame time period F2, switching signal SCAN having pulse width W1 and pulse voltage V1 is applied to the gate of the first switching device Q1 and the voltage of the luminance signal DATA is 0. Consequently, the electric charge stored in the storage capacitor Cs is discharged in the time period t3 (time constant $\tau 1$) and thereby the voltage Vcs at the storage capacitor Cs becomes 0 (FIG. 4 (*d*)).

As shown in FIG. 1, the aforementioned voltage Vcs is equal to the gate voltage Vg2 of the second switching device Q2. Thus, when the voltage Vcs (Vg2) becomes high, the second switching device Q2 becomes closed (ON) and thereby the resistance becomes low. Thus, the voltage VEL applied at both the electrodes of the electroluminescent device CEL varies. In other words, when the second switching device Q2 is open (OFF), the voltage VEL applied at both the electrodes of the electroluminescent device CEL is a value such that the electroluminescent device driving power supply Va (FIG. 4 (*c*)) is divided by the electroluminescent device CEL and the dividing capacitor Cdv ($VEL=-(Va\times Cdv)/(CEL+Cdv)$). On the other hand, in the event that the second switching device Q2 is closed (ON), the resistance becomes low and thereby the voltage VEL applied between both the electrodes of the electroluminescent device CEL is decreased.

The electroluminescent device CEL emits light at a threshold level upon application of a threshold voltage VTEL across its terminals. A desired luminosity can be achieved, however, by adding an additional voltage VMOD to the threshold voltage VEL. The electroluminescent device emits light when the second switching device Q2 is in the off-state (open). As noted above, when Q2 is in the off-state, the voltage applied across the terminals of the electroluminescent device is:

$$VEL=(Va\times Cdv)/(CEL+Cdv).$$

Thus, in order to achieve a desired luminosity, CEL and Cdv may be selected such that VEL=VTEL+VMOD.

When the second switching device Q2 is in the on-state (closed), the electroluminescent device CEL does not emit light and VEL must necessarily be set to a value below the threshold voltage VTEL.

Figure 5:
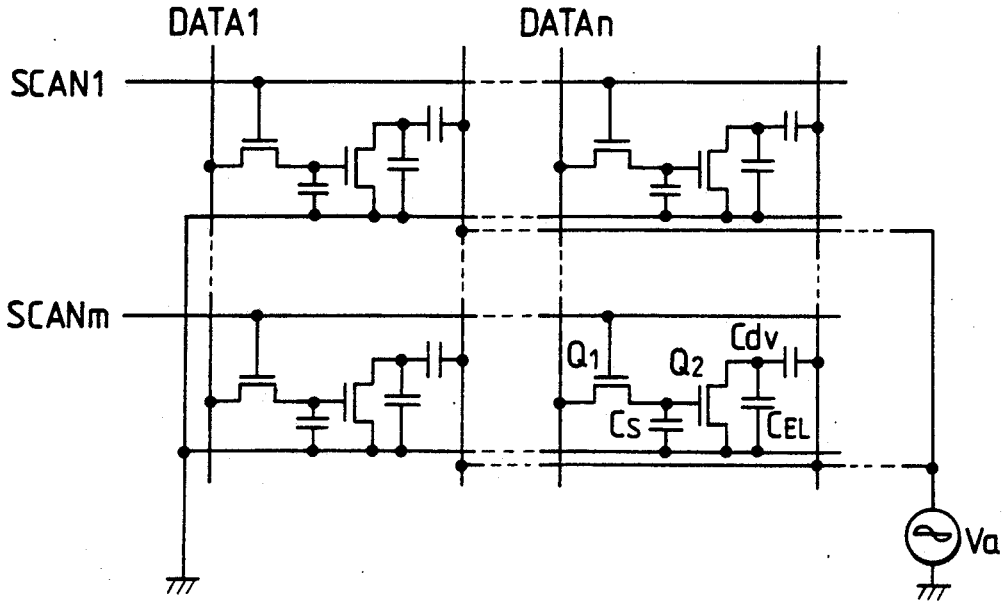
FIG. 5 is a diagram of a driving circuit in a matrix type electroluminescent display device embodying the present invention.
Figure 6:
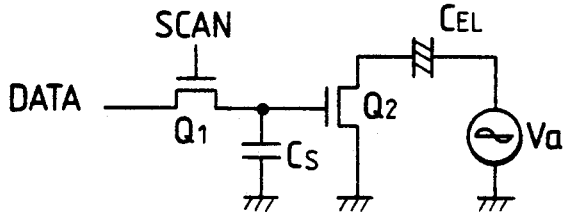
FIGS. 6 and 7 are diagrams of conventional electroluminescence device driving circuits, which are prior art and related art, respectively.

FIG. 5 shows a driving circuit of a matrix type electroluminescent display device having m×n bits, embodying the present invention. In the figure, a plurality of driving circuits according to the present invention are arranged in a matrix. Each drive circuit shown in FIG. 5 is similar to that shown in FIG. 1. Thus, the circuit components shown in FIG. 5 are identified with the same letters and their description is omitted.

Under the foregoing conditions, the driving circuit of the present invention can now advantageously incorporate a second switching device Q2 having an offset drain structure and a semiconductor layer of amorphous silicon (a-Si). As discussed above, although a high withstand voltage can be achieved, the second switching device Q2 having this construction has a reduced drain current when a negative drain bias is applied in the on-state. Nevertheless, light emission by the electroluminescent device is unaffected by this reduced drain current because illumination occurs when the second switching device Q2 is in the off-state. Since the second switching device has a high withstand voltage and low off-current, the electroluminescent device CEL emits light at a desired luminosity and does not require the application of an excessive voltage from driving power supply Va.

In addition, since amorphous silicon (a-Si) which is used as the semiconductor layer of the second switching device Q2, the electroluminescent device driving circuit of the present invention can be made with a low temperature process. Further, matrix type electroluminescent display devices and electroluminescent device arrays, can be structured in extended monolithic arrangements with the switching devices.

Figure 7:
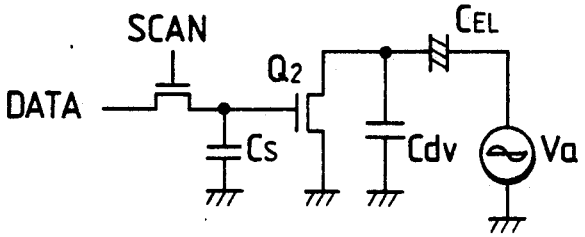

As noted above, the second switching device Q2 of the driving circuit shown in FIG. 7 is subject to an electrochemical reaction acceleration factor because of a DC component of the electric charge stored in the dividing capacitor Cdv. This DC component is generated when the switching device Q2 is changed from ON to OFF. However, in the driving circuit of the present invention, the DC component is reduced when the second switching device Q2 is turned off. Thus, the electrochemical reaction acceleration factor is also reduced. Consequently, the reliability of the second switching device Q2 is improved.

It will be apparent to those skilled in the art that various modifications and variations can be made in the electroluminescent device driving circuit of the present invention and in construction of this electroluminescent device driving circuit without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electroluminescent device driving circuit comprising:

a first switching device having first, second, and third terminals, the second terminal acting to open or close said first switching device in accordance with a switching signal applied thereto, wherein a current flows between the first and third terminals when said first switching device is closed;

a second switching device having first, second, and third terminals, the second terminal acting to close said second switching device in accordance with a voltage applied thereto, wherein a current flows between the first and third terminals when said first switching device is closed, the third terminal of said first switching device being electrically coupled to the second terminal of said second switching device;

an electroluminescent device having first and second terminals, the first terminal of said electroluminescent device being electrically coupled to the first terminal of said second switching device and the second terminal of said electroluminescent device being electrically coupled to the third terminal of said second switching device, wherein the electroluminescent device illuminates when said second switching device is open; and a dividing capacitor having first and second terminals, the first terminal of said dividing capacitor being adapted for coupling to an electroluminescent device driving power supply, and said second terminal of said dividing capacitor being electrically coupled to said first terminal of said first switching device and said first terminal of said electroluminescent device.

2. The electroluminescent device driving circuit of claim 1 wherein the first, second, and third terminals of said first and second switching devices are drain, gate, and source terminals respectively.

3. The electroluminescent device driving circuit of claim 1, further comprising a storage capacitor such that said storage capacitor is charged or discharged in accordance with said switching signal and said voltage applied to the second terminal of the second switching device is a discharge voltage from said storage capacitor.

4. The electroluminescent device driving circuit of claims 1 or 3, further comprising:

an electroluminescent device driving power supply having first and second terminals wherein the first terminal of said electroluminescent device driving power supply is electrically coupled to the first terminal of said dividing capacitor, said second terminal of said electroluminescent device driving power supply is electrically coupled to said third terminal of said second switching device and said second terminal of said electroluminescent device, said second terminal of said dividing capacitor being electrically coupled to said first terminal of said first switching device and said first terminal of said electroluminescent device.

5. The electroluminescent device driving circuit of claim 4, wherein the first, second, and third terminals of said first and second switching devices are drain, gate, and source terminals respectively.

6. The electroluminescent device driving circuit of claim 1, wherein said second switching device comprises a semiconductor layer.

7. The electroluminescent device driving circuit of claim 6, wherein said semiconductor layer is amorphous silicon.

8. The electroluminescent device driving circuit of claim 2, wherein said drain of said second switching device has an offset structure.

9. The electroluminescent device driving circuit of claim 5, wherein said drain of said second switching device has an offset structure.

* * * * *